US011369537B2

(12) United States Patent
Katzenstein et al.

(10) Patent No.: US 11,369,537 B2
(45) Date of Patent: Jun. 28, 2022

(54) HEAD PLATE PROVIDED FOR AN OPERATING TABLE AND ADJUSTABLE WITH ONE HAND

(71) Applicant: MAQUET GMBH, Rastatt (DE)

(72) Inventors: Bernhard Katzenstein, Iffezheim (DE); Immanuel Gaiser, Weisenbach (DE); Jens Schröter, Karlsruhe (DE); Rodrigo Del Alcazar Von Buchwald, Karlsruhe (DE); Thomas Krickeberg, Karlsbad (DE)

(73) Assignee: MAQUET GMBH, Rastatt (DE)

( * ) Notice: Subject to any disclaimer, the term of this patent is extended or adjusted under 35 U.S.C. 154(b) by 90 days.

(21) Appl. No.: 16/765,121

(22) PCT Filed: Nov. 16, 2018

(86) PCT No.: PCT/EP2018/081571

§ 371 (c)(1),
(2) Date: May 18, 2020

(87) PCT Pub. No.: WO2019/096999

PCT Pub. Date: May 23, 2019

(65) Prior Publication Data

US 2020/0345573 A1 Nov. 5, 2020

(30) Foreign Application Priority Data

Nov. 17, 2017 (DE) ..... 10 2017 127 177.5

(51) Int. Cl.
*A61G 13/12* (2006.01)
*A61G 13/08* (2006.01)

(52) U.S. Cl.
CPC ..... *A61G 13/121* (2013.01); *A61G 13/08* (2013.01); *A61G 2200/327* (2013.01)

(58) Field of Classification Search
CPC ..... A61G 13/121; A61G 13/08; A61G 7/072; A61G 7/065; A61G 7/05; A61G 13/1205;
(Continued)

(56) References Cited

U.S. PATENT DOCUMENTS 5,177,823 A 1/1993 Riach
5,427,436 A 6/1995 Lloyd
(Continued)

FOREIGN PATENT DOCUMENTS

CN 2772483 Y 4/2006
CN 2880046 Y 3/2007
(Continued)

OTHER PUBLICATIONS

"Remote." Merriam-Webster, Merriam-Webster, www.merriam-webster.com/dictionary/remote.*
(Continued)

*Primary Examiner* — David R Hare
*Assistant Examiner* — Madison Emanski

(57) ABSTRACT

Multi-part displaceable head plate (1) for an operating table (30), comprising: a coupling arrangement (2), a positioning segment (3) for positioning the head plate (1), a head support segment (4) for supporting the head of the patient, and an unlocking device (24) for unlocking two joint arrangements (5), (6).

The positioning segment (3) and the head support segment (4) are each pivotably connected to the coupling arrangement (2) and to the positioning segment (3), via a first (5) and a second (6) joint arrangement respectively.

20 Claims, 7 Drawing Sheets

(58) Field of Classification Search
CPC ..... A61G 13/12; A61G 13/1295; A61G 13/0054; A61G 15/125
See application file for complete search history.

(56) References Cited

U.S. PATENT DOCUMENTS

| | | | | |
|---|---|---|---|---|
| 6,594,839 | B1 * | 7/2003 | Papay | A61G 13/12 297/405 |
| 7,610,639 | B2 | 11/2009 | Roleder et al. | |
| 7,761,943 | B2 | 7/2010 | Roleder et al. | |
| 2005/0067875 | A1 | 3/2005 | Debraal et al. | |
| 2005/0160532 | A1 | 7/2005 | Froelich | |
| 2006/0053557 | A1 | 3/2006 | Damron | |

FOREIGN PATENT DOCUMENTS

| | | | |
|---|---|---|---|
| CN | 102836046 | A | 12/2012 |
| CN | 102871818 | A | 1/2013 |
| CN | 204863847 | U | 12/2015 |
| CN | 205054731 | U | 3/2016 |

OTHER PUBLICATIONS

"Axis." Merriam-Webster, Merriam-Webster, www.merriam-webster.com/dictionary/axis.*
International Search Report dated Feb. 27, 2019 for corresponding PCT Application No. PCT/EP2018/081571, 2 pages.
Office Action and search report dated Dec. 24, 2021 in Chinese Application No. 201880074039.4, 7 pages.

* cited by examiner

HEAD PLATE PROVIDED FOR AN OPERATING TABLE AND ADJUSTABLE WITH ONE HAND

BACKGROUND OF THE DISCLOSURE

The disclosure relates to a multi-part displaceable head plate for an operating table according to the preamble of claim 1.

During an operation, a patient is lying on his back, stomach or side on an operating table. His head can be supported by a head plate attached to the operating table.

Immediately before some operations, the patient must be anesthetized and connected to a ventilator. For this purpose, an anesthetist has to stretch the head of the patient positioned in a supine position for intubation. This can be achieved by folding the head plate down. In order to position the patient's head as gently as possible, the anesthetist should support the head in the area of the neck with one hand, while unlocking, adjusting the angle and securely fixing the head plate with his free hand.

In particular in the case of neurosurgical interventions, in which the position of the head has to be positioned and fixed several times in a targeted manner, adjustable head plates are required, which can be displaced without vibration and securely fixed. It is also advantageous for lying in prone and lateral positions if the surgeon or the nurse, hereinafter also referred to as the user, can support the patient's head while using one hand to adjust the inclination of the head plate and then fix it.

Displaceable head plates, which have a joint blocked on one side for the existing joint arrangement of the head plate, are known from the prior art. For this purpose, manually releasable gas springs, which can be operated either on both sides or centrally from the distal end of the head plate, are often used in single-joint head plates. The weight of the head plate is balanced by the use of gas springs, so that no considerable manual force is required to pivot the head plate with one hand.

However, such solutions are not known for two-part head plates. Due to the size of the gas springs, head plates are predominantly made with gas springs attached on one side, which has a negative impact on the rigidity of the head plates under load.

To increase the stability of multi-part head plates, joint blocking mechanisms are used on both sides. For this purpose, the use of head plates with four-bar joints, each of which has three rotary joints and one sliding joint with a joint locking mechanism, is known in the art. With some head plates, two four-bar joints are used, wherein a thrust joint is blocked by a gas spring, while the thrust joint is fixed on the opposite side of the head plate by a spindle with a blockable spindle nut.

Basically, however, pivot joint blocking mechanisms, which are implemented with coupling gears and latchable thrust joints, are restricted to the extent that the adjustable angular range is restricted due to occurring dead center positions.

In order to avoid this problem, solutions are known in the prior art which implement the coupling function by means of radially or axially acting form-fitting or frictional coupling elements.

Experience has shown, however, that the operation and synchronization of different blocking mechanisms on a head plate are difficult. When using several manually operated blocking and locking mechanisms, a confusion of the respective control units cannot be ruled out, so that there is a risk of unintentional unlocking of a joint during an operation. Solutions with several individually operated blocking mechanisms are also ergonomically disadvantageous.

This problem is eliminated in the case of head plates with a single control element, which fixes or releases the rotation of all joints at the same time. Such a generic head plate is shown for example in FIG. 1. This previously known two-joint head plate 1' comprises a first rotary joint 2', which is used to position and lower a first head plate segment (frame 7') relative to the lying surface of an operating table 4', while a second rotary joint 3' is used to rotate a second head plate segment (carrier plate 8') relative to the first head plate segment 7'. This head plate can be coupled to further segments of an operating table 4' by means of two single clamps 10' with claws 9'.

To release and latch the rotation of the two segments 7', 8' which can be set at an angle to one another, in the head plate 1' shown in FIG. 1 a single actuating element in the form of a toggle 5' is provided, which is attached centrally to the outer edge region of the frame 7'. The joints 2', 3' of the two axes of rotation A', B' have a form-fitting block, which is unlocked by cable pulls (not shown). The active release of the joints can thus be controlled by synchronously actuating a Bowden cable on the toggle 5. It is important that bending forces on the Bowden cable core are avoided and only pure tensile forces are transmitted in order to prevent premature breakage. The Bowden cable of the known head plate 1' is mounted with spring support and enables active disengagement, but no engagement, of latching elements. Such a design of the unlocking mechanism is structurally very complex and not torsion-proof. In addition, it requires an increased effort due to the increased friction and leverage, as well as complex assembly and adjustment.

In order to release the latching mechanism of the joints 2', 3' of the head plate 1', a user has to rotate and hold the toggle 5' with one hand, while adjusting the desired height and inclination of the carrier plate 8' with the other hand. This no longer leaves a hand free to support the patient's head and protect it from uncontrolled movements.

A sensitive positioning of the patient's head is therefore only possible to a limited extent during an operation by an individual user. To make this possible, it is usual for one person to lift the patient's head while another person is operating the head plate and bringing it into the desired position.

Furthermore, when pivoting the head plate 1' already known from the prior art, there is a risk for the user of jamming his hands between the frame 7', the carrier plate 8' and a lateral standard rail 6'.

SUMMARY OF THE DISCLOSURE

The disclosure is therefore based on the object of specifying a multi-part displaceable head plate for fastening to an operating table, with which the adjustment of the desired position of the head plate segments can be handled safely and conveniently by one single user.

The disclosure achieves this object by means of the head plate with the features of claim 1.

The multi-part displaceable head plate according to the disclosure for an operating table can comprise at least one of the following components:

- a coupling arrangement for releasably coupling the head plate to the operating table;
- a positioning segment for positioning the head plate, wherein the positioning segment can be pivotably connected to the coupling arrangement via a first joint arrangement that can be locked against pivoting;

a head support segment for supporting the head of a patient, wherein the head support segment can be pivotably connected to the positioning segment via a second joint arrangement that can be locked against pivoting; and an unlocking device for unlocking both joint arrangements.

The unlocking device can include the following components:

a) an actuating device for actuating the unlocking device by the user, and/or b) a first unlocking mechanism for unlocking the first joint arrangement, which can mechanically couple the actuating device to the first joint arrangement, wherein the first unlocking mechanism can comprise an adjustable coupling device.

The actuating device can be arranged on the head support segment. Furthermore, starting from the head support segment, the coupling device can extend from the actuating device to the second joint arrangement and, in the unlocked state, can adopt such a position that pivoting of the head support segment relative to the positioning segment is possible in any angular position.

Advantageous further developments are specified in the subclaims.

In some embodiments, the head plate coupling device can be rotatable about a first pivot point that can be remote from the actuating device. The position of the coupling device in the unlocked state can be such that the first pivot point lies on the pivot axis of the second joint arrangement.

In the unlocked state, the coupling device can be aligned radially with respect to the pivot axis of the second joint arrangement.

Furthermore, the first unlocking mechanism can comprise a release element which can be adjustably mounted between the first and the second joint arrangement and can be connected to the actuating device, for example, via the coupling device.

The coupling device can be articulated rotatably on the release element via the first pivot point.

In some embodiments, the coupling device can convert a rotational movement of the actuating device into a translational movement of the release element for unlocking the first joint arrangement.

The release element can comprise a first end section assigned to the first joint arrangement and a second end section assigned to the second joint arrangement. The first end section can be designed as a latching element. The second end section can be connected to the coupling device via a pivot joint.

The unlocking device can have a second unlocking mechanism for unlocking the second joint arrangement. The second unlocking mechanism can have complementary latching elements, one of which can be formed on the positioning segment and the other on the actuating device.

In the second unlocking mechanism, the latching element formed on the positioning segment can be in the form of a tooth arch, wherein the tooth arch can be arranged coaxially to the axis of rotation.

Furthermore, the unlocking device can have a blocking device for blocking the position of the actuating device in the locked state in order to prevent inadvertent actuation of the actuating device.

The blocking device can be rotatably mounted in the actuating device and can be designed such that it can be switched between two discrete latching positions, namely a first latching position for securing the actuating device and a second latching position for releasing the actuating device.

The blocking device can cooperate with a blocking spring to selectively secure or release the actuator.

The unlocking device can be designed so that it can be used to unlock and re-lock both joint arrangements simultaneously.

Alternatively, the unlocking device can be designed such that it can be used to unlock and re-lock the joint arrangements sequentially.

The actuation device can comprise two actuation elements, which can each be arranged on opposite sides of the head support segment. It can additionally comprise a synchronization element, by means of which a movement of one actuating element can be transmitted to the other actuating element.

The synchronization element of the present head plate can be designed as a switching tube.

In some embodiments of the present head plate, the blocking device can comprise a switching rod arranged coaxially in the switching tube.

The head plate according to the disclosure is characterized in that the actuating device for actuating the unlocking device is arranged in a particularly ergonomically favorable position on the second segment, namely the head support segment. As a result, the user can operate the unlocking device of both joint arrangements with one hand, can simultaneously secure the head support segment against uncontrolled lowering with the same hand, can pivot the headplate segments with the same hand, and can then securely fix them again without having to let go of the actuating device or even changing the actuating hand. As a result, the user can keep one hand on the head support segment during the entire head support displacement process, while at the same time maintaining control over the position of the head plate and securing the patient's head with the free hand. Such positioning of the actuating device ensures a particularly safe and user-friendly handling of the head plate. In particular, it is advantageous that the user can adjust the head plate segments independently and with one hand.

Due to the ergonomically advantageous arrangement of the actuating device on the head support segment, however, there is the mechanical problem that the unlocking mechanism for unlocking the first joint arrangement has to be guided over the second joint arrangement.

The unlocking mechanism must be implemented in such a way that it enables the first joint arrangement to be unlocked without its presence impairing the rotation of the second joint arrangement.

According to the disclosure, this is achieved by the special positioning and the coordinated behavior of the coupling device.

Moving the toggle 5' from the frame 7' to the support plate 8' is not readily possible with the previously known head plate 1' from FIG. 1, because the Bowden cables would then be in the way and would jam when the support plate 8' is pivoted.

Thus, the present head plate offers an extremely user-friendly and simple design. The unlocking mechanism according to the disclosure is resistant to bending and torsion, simple to construct, and very reliable to operate. The unlocking mechanism of the present head plate, which can be both actively disengaged and also actively engaged, is particularly advantageous.

The configuration of the unlocking mechanism of the first joint arrangement according to the disclosure with a cleverly provided and arranged adjustable coupling device makes it possible to pivot the head support segment with respect to the positioning segment in any possible angular position and to fix it in any possible angular position. The unlocking mechanism of the present head plate can be both frictional and form-fitting.

In some embodiments, however, it can be particularly advantageous to design the unlocking mechanism in such a way that the two head plate segments can be fixed in steps, in particular by form fitting. In this case, the alignment of the head plate in a desired, for example horizontal, plane is made easier for the user. This also prevents the head plate from being fixed in a twisted manner, which in turn rules out a one-sided loading of the locked joint arrangements.

The operating elements can be realized on both sides of the head plate by an embodiment of the head plate that is advantageously configured symmetrically to the center plane of the operating table. With a corresponding synchronization, the operating elements can be actuated both with the right hand on one side of the head plate and also with the left hand on the other side of the head plate. Accordingly, the operating hand can change from one side to the other. In addition, the head plate operation is user-friendly for both right-handed and left-handed users.

BRIEF DESCRIPTION OF THE DRAWINGS

An exemplary embodiment of the disclosure is explained in more detail below with reference to the figures. In the drawings.

DETAILED DESCRIPTION

In the following description, exemplary embodiments of the present disclosure are described with reference to the drawings. The drawings are not necessarily to scale, but are only intended to illustrate the respective features schematically.

It should be noted that the features and components described below can each be combined with one another, regardless of whether they have been described in connection with a single embodiment. The combination of features in the respective embodiments merely serves to illustrate the basic structure and the mode of operation of the claimed device.

Figure 1:
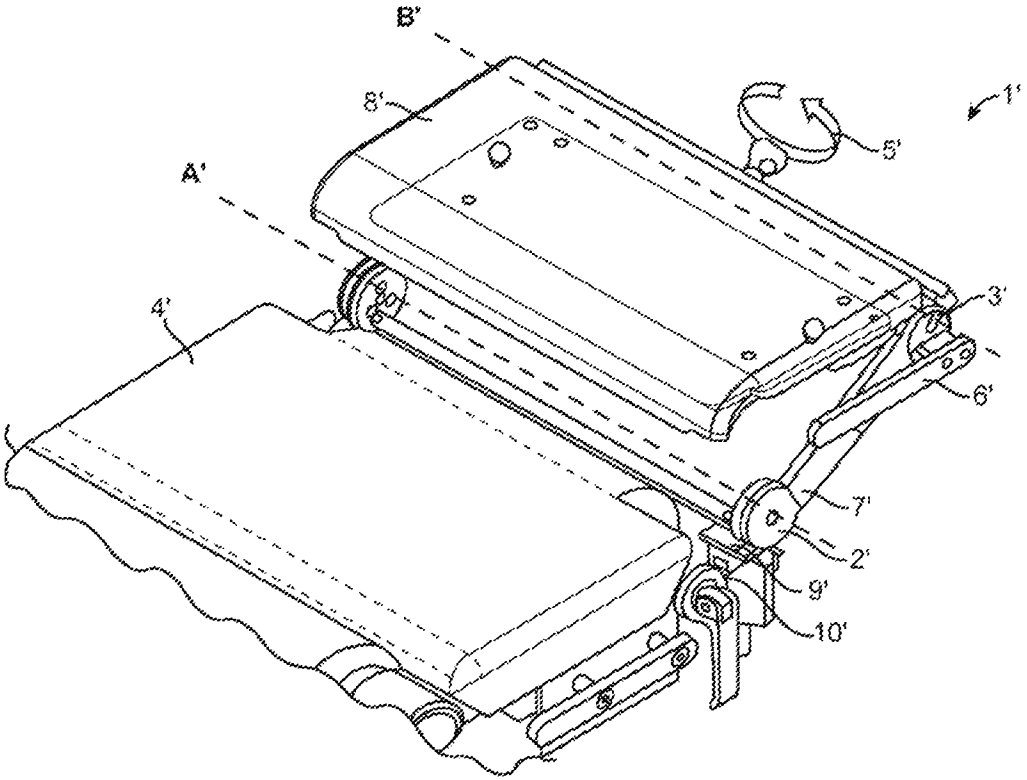
FIG. 1 (Prior art)
FIG. 1 shows a perspective view of a two-part head plate already known from the prior art.
Figure 2:
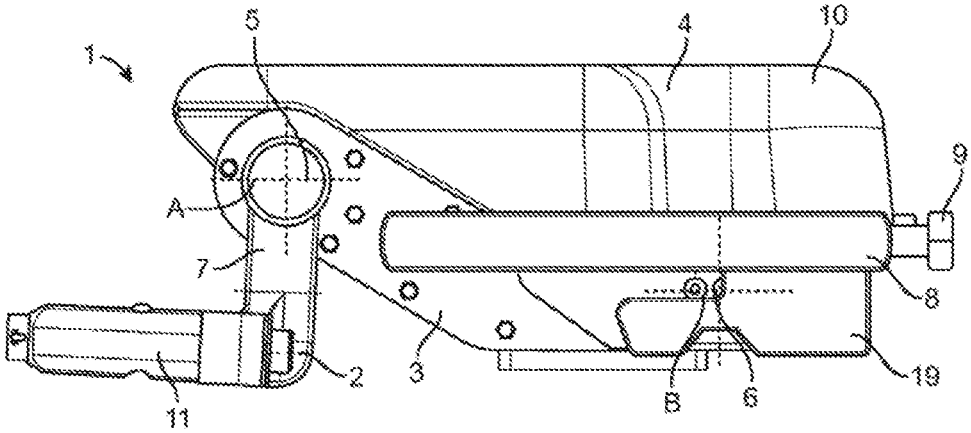
FIG. 2 shows a side view of a multi-part displaceable head plate in a horizontal starting position of the head support segment, which represents an exemplary embodiment of the disclosure.

FIG. 2 is a side view showing a multi-part head plate 1 according to the disclosure as an embodiment. The head plate 1 serves to support the head of a patient lying on an operating table 30 (see FIG. 6) during an operation.

As shown in FIG. 2, the head plate 1 comprises a coupling arrangement 2 for coupling to the operating table and two head plate segments 3 and 4. In this case, a first head plate segment is designed as a positioning segment 3 for positioning the head plate 1 and a second head plate segment as a head support segment 4 for supporting the patient's head.

Furthermore, the head plate 1 comprises two joint arrangements 5, 6, each with an axis of rotation A and B (see the two crosses in FIG. 2), which are spaced apart from one another. While the positioning segment 3 is pivotably connected to the coupling arrangement 2 via the first joint arrangement 5, the head support segment 4 can be pivoted relative to the positioning segment 3 about the axis of rotation B of the second joint arrangement 6.

The head support segment 4 comprises an actuating device 23 described later in detail (see FIG. 6), an e.g. padded head support plate 10, two side slide rails 8 (only one is shown in FIGS. 2-5) and a front-positioned mounting rail 9 for attaching accessories, such as e.g. an operating device, a tube holder for breathing tubes or a drip stand.

The coupling arrangement 2 has two pin joints 11 for fastening in each case, for example, to one end of a side rail of an operating table 30 (see FIGS. 6-10 and 13). In some embodiments, the pin joints 11 can each have a right-angled profile that has an "L shape" in cross section. For example, the coupling arrangement 2 can comprise two connecting sections 7, which are oriented perpendicularly to the patient support surface, and two pin joints 11 which are substantially horizontal.

Figure 3:
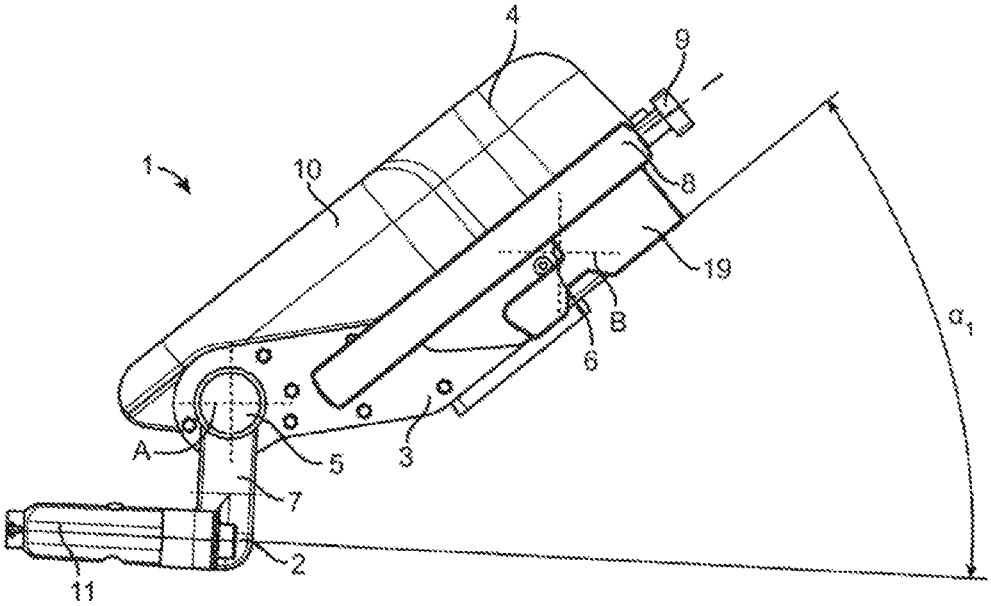
FIGS. 3-5 show side views of the head plate of FIG. 2 in different displacement positions of the head plate segment.
Figure 4:
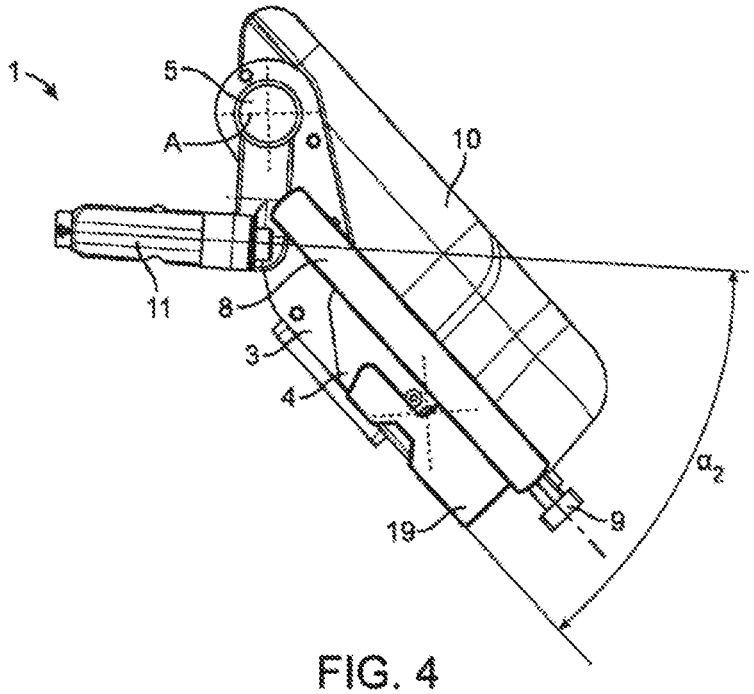
Figure 5:
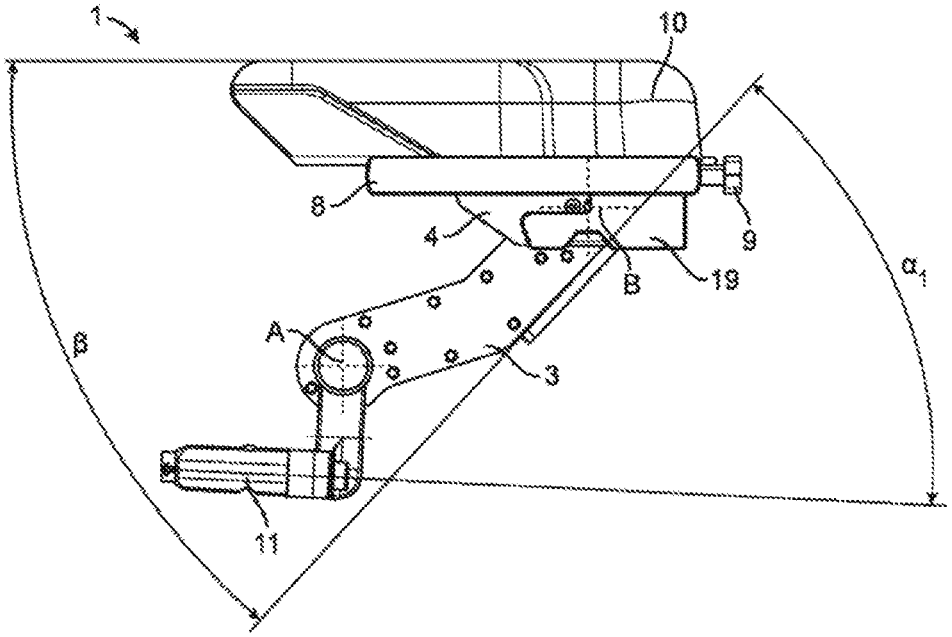

FIGS. 3-5 show further side views of the head plate 1 according to the disclosure in different angular positions of the head plate segments 3 and 4.

The present head plate 1 enables, via a first degree of freedom of rotation of the positioning segment 3 about the axis of rotation A, a displacement of the positioning segment in the angular ranges $\alpha_1$ and $\alpha_2$ and, via a second degree of freedom of rotation of the head support segment 4 about the axis of rotation B, a displacement of the head support segment in the angular range $\beta$, which can be fixed in stages.

The positioning segment 3 can be positioned from an undisplaced initial position of the head plate 1, the height and orientation of which in the coupled state correspond to the height and orientation of the patient support surface (FIG. 2), by the inclination angle $\alpha_1$ or lowered by the inclination angle $\alpha_2$ (FIGS. 3 and 4). In addition, the head plate 1 can be displaced by the angle of rotation $\beta$, in that the head support segment 4 is pivoted about the axis of rotation B of the second joint arrangement 6 relative to the positioning segment 3.

These displacement possibilities for the top plate 1 have the advantage that a lateral positioning of the patient during an operation can be realized without problems. For this the patient's head—depending on the shoulder width—is stored a few centimeters above the body support surface on the positioned head support segment 4 in order to achieve optimal relief of the head and shoulder muscles, which corresponds to a stepped positioning of the head.

Figure 6:
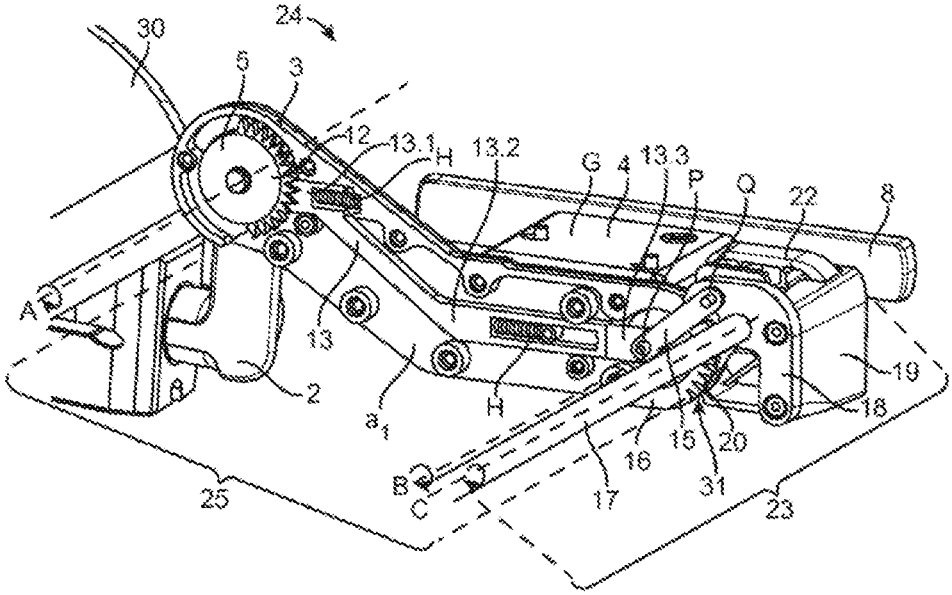
FIG. 6 shows a perspective view of a detail of an unlocking device of the head plate of FIGS. 2-5 attached to an operating table, wherein the joint arrangements are in a locked state and the unlocking device is in a blocked state.
Figure 7:
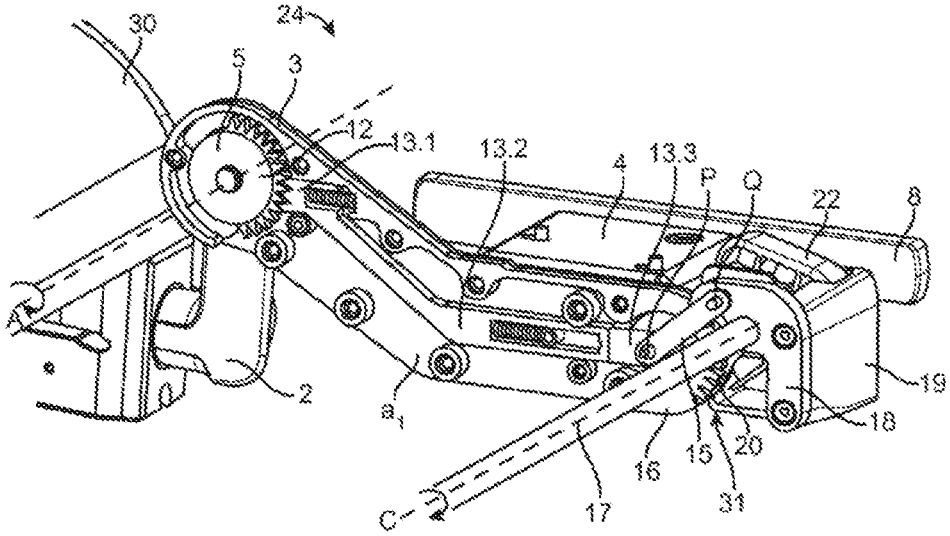
FIG. 7 shows a perspective view of a detail of the unlocking device of FIG. 6, wherein the joint arrangements are in a locked state and the unlocking device is in an unblocked state.
Figure 8:
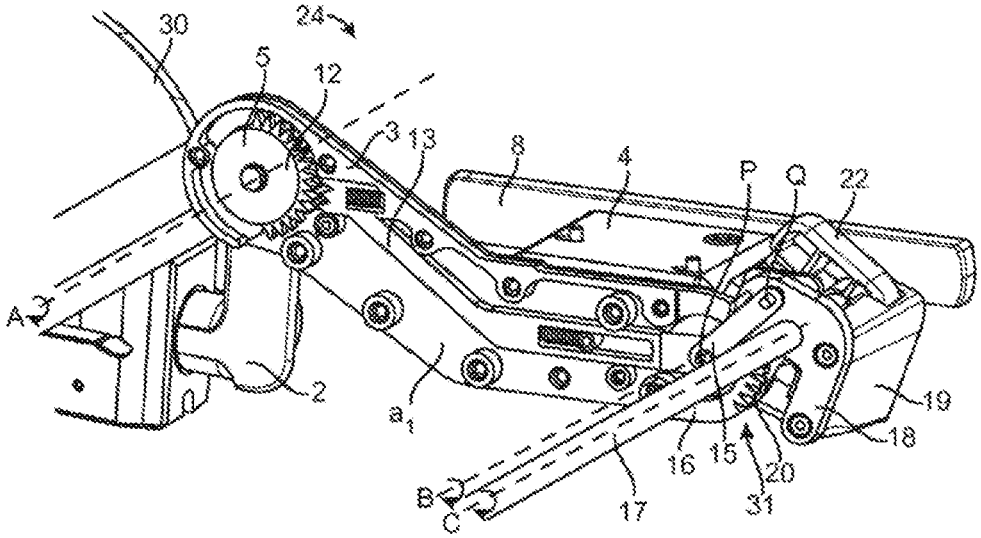
FIG. 8 shows a further perspective view of a detail of the unlocking device of FIGS. 6 and 7, wherein the joint arrangements are in an unlocked state and the unlocking device is in an unblocked state.

FIGS. 6-8 show the internal structure of the operating table 30 mounted on the top plate 1 of FIGS. 2-5. It should be noted that the two head plate segments 3, 4, the joint arrangements 5, 6, and the actuating and blocking devices 18, 19, 22 are constructed in mirror symmetry with respect to a plane running longitudinally through the center of the head plate 1. For the sake of clarity, only components of a single top plate side are therefore shown in FIGS. 6-8.

FIG. 6 shows an unlocking device 24 for unlocking the two joint arrangements 5, 6. This comprises an actuating device 23 which is attached to the head support segment 4 and which serves to actuate the unlocking device 24 by a user, a first unlocking mechanism 25 for unlocking the first joint arrangement 5 and a second unlocking mechanism 31 for unlocking the second joint arrangement 6.

The actuating device 23 comprises, on each side of the head plate, an actuating element in the form of an actuating sleeve 19 and a switching plate 18 rigidly connected to it, as well as a synchronization element in the form of a switching tube 17, each switching plate 18 together with the actuating sleeve 19 being pivotably mounted about the longitudinal axis C of the switching tube 17. The switching tube 17 connects the actuating sleeve 19 on the left side of the head plate to an actuating sleeve 19 on the right side of the head plate (see FIGS. 11, 12).

Each switching plate 18 is located on a side of the actuating sleeve 19 facing the patient's head and is designed such that it has latching elements (not shown) at one end which engage in a receiving element 16 located in the second joint arrangement 6 in the radial direction of this joint arrangement 6. This fixes the rotation of the head support segment 4 about the B axis (FIG. 6). For example, each receiving element 16 consists of a circular, toothed region 20, which is formed on an arm $\alpha_1$, $\alpha_2$ of the positioning segment 3.

The latching elements of the switching plate 18 are designed such that they engage in a plane perpendicular to the axes of rotation B and C in the corresponding latching recesses in the toothed region 20 of the receiving element 16.

Together, the two receiving elements 16 with the toothed region or tooth arch 20 and the latching elements of the two switching plates 18 form the second unlocking mechanism 31.

The first unlocking mechanism 25 mechanically couples the actuating device 23 to the first joint arrangement 5. For this purpose, it has an elongated release element 13 and an adjustable coupling device 15 with the function of a coupling rod on both mirror-symmetrical sides of the head plate 1. Each release element 13 is movably mounted in a guide of the arm $a_1$, $a_2$ of the positioning segment 3 between the two joint arrangements 5, 6 and is connected via the coupling device 15 to a switching plate 18 of the actuating device 23. In some embodiments, the coupling device 15 is formed as a rigid member, such as a sheet or a rod.

Starting from the head support segment 4, each coupling device 15 runs from the actuating device 23 to the second joint arrangement 6. In particular, each coupling device 15 is articulated pivotably at one end about a second pivot point Q on a switching plate 18 and is articulated pivotably at the other end about a first pivot point P on a release element 13.

In the locked basic position of the head plate 1 shown in FIG. 6, the latching elements of the switching plates 18 are in engagement with the toothed regions 20 of the receiving elements 16 of the arms $a_1$, $a_2$, whereby the rotation of the head support segment 4 about the B axis is fixed. Furthermore, the adjustable coupling devices 15 are in a locked position. In the locked position, each coupling device 15 extends obliquely between a switching plate 18 and a release element 13. The first pivot point P is radially offset with respect to the axis of rotation B of the second joint arrangement 6. In particular, the first pivot point P is offset radially inward with respect to the axis of rotation B in the direction of the coupling arrangement 2.

In the present embodiment, each release element 13 is designed as a fork-shaped tooth piece, which is in spring-assisted engagement (H) with a tooth arch 12 mounted in each case in the first joint arrangement 5. Furthermore, the tooth arches 12 are rigidly connected to the coupling arrangement 2. The first joint arrangement 5 is thus locked.

Each release element 13 comprises a first end section 13.1 assigned to the first joint arrangement 5, a second end section 13.3 assigned to the second joint arrangement 6, and a main body 13.2 which extends between the two end sections 13.1, 13.3 and is angled, for example. The first end section 13.1 forms a toothed engagement head.

In the unlocked state shown in FIG. 8, the coupling devices or also tension plates 15 are in an unlocked position. In this position, the first pivot point P lies on the pivot axis B of the second joint arrangement 6.

Figure 9:
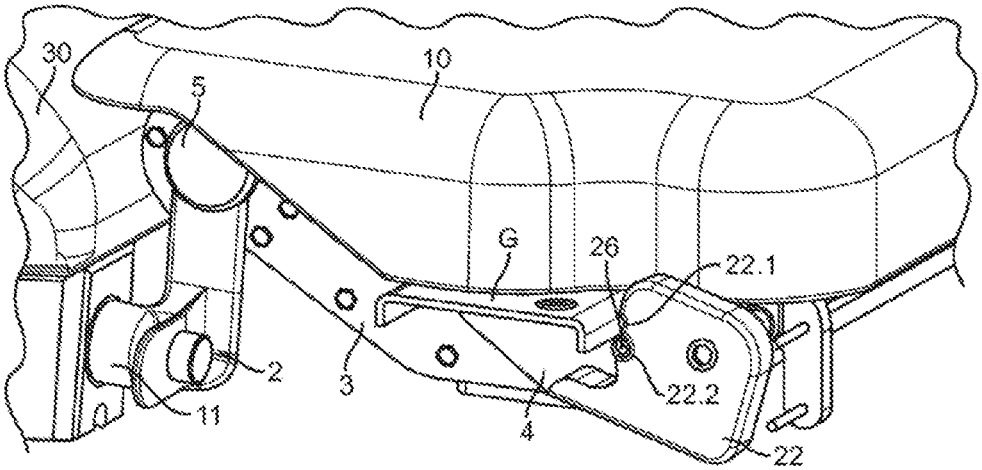
FIG. 9 shows a perspective view of a blocking device with deactivated blocking of the actuating device; A part of the actuating element has been omitted for the sake of clarity.
Figure 10:
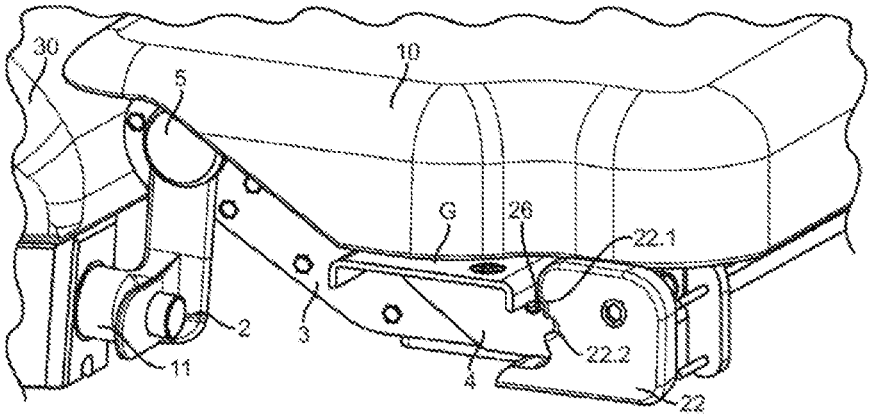
FIG. 10 shows a perspective view of the blocking device of FIG. 9 with activated blocking of the actuating device; A part of the actuating element has been omitted for the sake of clarity.

Furthermore, the unlocking device 24 comprises a blocking device 22 for blocking the rotation of the actuating device 23 about the axis of rotation C. The blocking device 22 is rotatably mounted in the actuating sleeves 19 and is designed such that it can be switched between a lower and an upper discrete latching position. This prevents the joint arrangements 5, 6 from being unlocked unintentionally. The functioning of the blocking device 22 is shown in FIGS. 9 and 10 and is described below.

In the lower latching position (FIGS. 6, 10), the blocking device 22 presses a blocking spring 26 on each side of the head plate 1 under a joint plate G, which is part of the head support segment 4. The blocking spring 26 is deformed in the elastic region, similar to a leaf spring. Since the blocking spring 26 is non-rotatably connected to a wall of the actuating sleeve 19, the pivoting of the actuating device 23 can be blocked.

In the upper latching position (FIGS. 7-9), the blocking device 22 releases the blocking springs 26. In their relaxed position, the blocking springs 26 are no longer under the joint plates G. As a result, the actuating device 23 can be pivoted about the C axis.

The blocking device 22 has first spring receptacles 22.1. The blocking springs 26 sit in the lower latching position in these receptacles, where they are clamped under the joint plate G. Furthermore, the blocking device 22 has second spring receptacles 22.2. The blocking springs 26 are located in these receptacles in the upper latching position, where they are relaxed. The spring receptacles 22.1 and 22.2 are designed, for example, as concave recesses. In particular, the release receptacle 22.2 is a larger recess than the block receptacle 22.1.

To displace the head plate segments 3, 4, one of the rod-shaped slide rails 8 is gripped laterally with one hand. Thus, the user can unblock the blocking device 22 with one finger and the rotation of the actuating device 23 about the C axis is released (FIG. 7). Now the user grips the adjacent actuating sleeve 19 with the same hand and pivots it about the axis of rotation C relative to the positioning segment 3. The resulting rotational movement of the switching plate 18 actuates the second unlocking mechanism 31 and thus unlocks the second joint arrangement 6. At the same time, this rotary movement is converted by means of the coupling devices 15 into a translational longitudinal movement of the tooth pieces 13 in the positioning segment 3. This pulling movement is opposed to the spring force of the springs H and takes place orthogonally to the axes of rotation A, B. In this way, the first unlocking mechanism 25 is transferred from the fixed basic position shown in FIGS. 6, 7 to a release position illustrated in FIG. 8.

The coupling devices 15 exposed to the tensile force shift from their locking positions into their unlocking positions, so that the connection point of the tooth pieces 13 to the coupling devices 15 (i.e. the first pivot point P) in the second joint arrangement 6 lies on the axis of rotation B, and thus the pivoting of the head support segment 4 relative to the positioning segment 3 is possible in any angular position of the first joint arrangement 5. Such a configuration of the present unlocking device 24 enables the two joint arrangements 5, 6 to be unlocked and locked synchronously.

According to some embodiments, however, the unlocking device 24 can be designed such that it can be used to unlock and re-lock the joint arrangements 5, 6 sequentially. For example, the locking sequence of the two joint arrangements 5, 6 can be influenced by the shape of the adjustable coupling device 15. In an advantageous embodiment, the coupling device 15 can have an elongated hole at its second end facing the switching plate 18 (at the pivot point Q). At least one end of the elongated hole can form a stop for a connecting element of the switching plate 18 with the coupling device 15, the diameter of the connecting element corresponding to the width of the elongated hole.

Furthermore, the chronological sequence of locking and unlocking of the joint arrangements 5, 6 can be controlled by means of different engagement paths of the form-fitting engagement elements of the two joint arrangements 5, 6. The engagement paths can be determined, for example, by the length of the latching elements of the respective unlocking mechanism 25, 31, wherein only completely pulling out the latching elements from the opposing latching recess 12, 20 leads to the unlocking of the respective joint arrangement 5 or 6.

Furthermore, the unlocking device 24 can be constructed differently than shown in FIGS. 2-13. For example, the actuating device 23 together with the blocking device 22 can be positioned on the head support segment 4 such that, for the purpose of unlocking the two joint arrangements 5, 6, it is not pivoted, but rather is displaced either perpendicularly or parallel to the axes of rotation A and B.

In some embodiments of the present head plate 1, a translational outward and inward movement of the second unlocking mechanism 31 parallel to the axes of rotation A and B can be combined with a translational outward and inward movement of the first unlocking mechanism 25 in a plane perpendicular to the axes of rotation A and B.

In other embodiments, the translational engagement and disengagement movement of both unlocking mechanisms 25, 31 can take place, for example, parallel to the axes of rotation A and B.

After the release of the two joint arrangements 5, 6, the user can adjust the head plate 1 at an angle with the actuating hand. As soon as he releases the actuating device 23, the mechanism of the two joint arrangements 5, 6 locks automatically. This takes place e.g. by the force of two return springs F (see FIG. 12).

The locking of the arrangements 5, 6 can, for example, be spring-assisted (spring H). Alternatively, the joint arrangements 5, 6 can be actively locked by the user by the exertion of pressure. The user can then advantageously move the blocking device 22 into the lower latching position with his thumb.

After this step, the displacement of the head plate segments 3, 4 is completed and the head plate 1 is securely locked in its new position.

Such an unlocking mechanism ensures a particularly user-friendly handling of the head plate 1 and precludes inadvertent actuation of the unlocking device 24.

Figure 11:
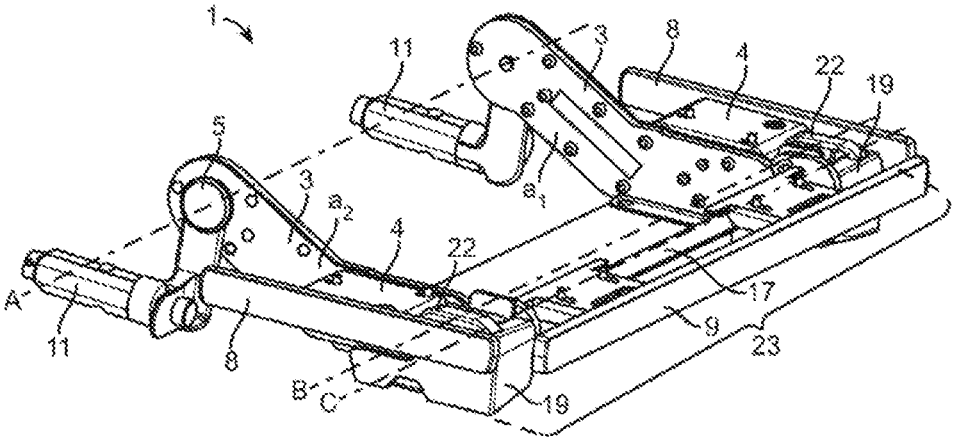
FIG. 11 shows a perspective overall view of the top plate of FIGS. 2-10, wherein a head support element of the head support segment has been omitted for the sake of clarity.
Figure 12:
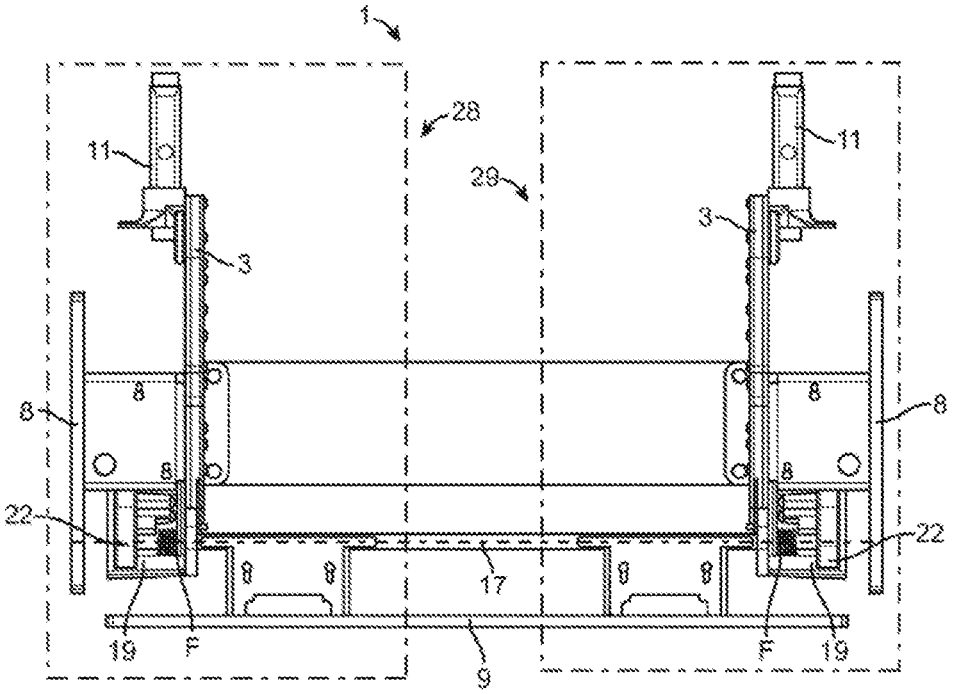
FIG. 12 shows a plan view of the symmetrical construction of the head plate of FIG. 11, wherein a head support element of the head support segment has been omitted for the sake of clarity.
Figure 13:
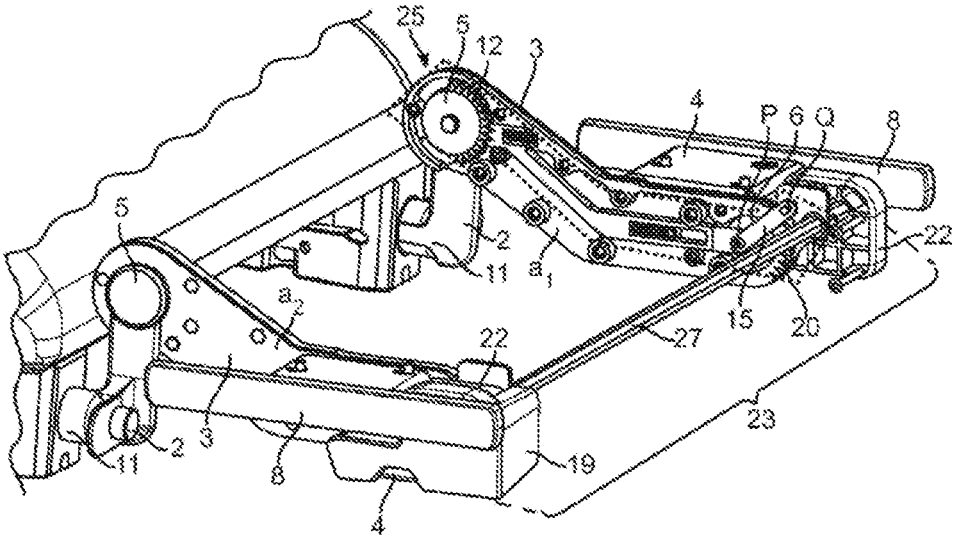
FIG. 13 a perspective view of the head plate from FIG. 11-12, the components of which are arranged mirror-symmetrically on the right and left sides, the switch rod of the blocking device being visible.

FIGS. 11-13 show the mirror-symmetrical design of the head plate 1. The blocking device 22 comprises a switching rod 27 guided in the connecting tube 17 (FIG. 13). In some embodiments, the switching rod 27 can have a round or polygonal cross section and can thus be present, for example, as a tube or hexagon.

The switching rod 27 connects the two sides of the blocking device 22 to one another. Thus, if the blocking device 22 is actuated on one side, the other side follows the movement of the actuated side because it is coupled in a rotationally rigid manner to the actuated side via the switching rod 27. The switching rod 27 is aligned coaxially with the axis of rotation C. In addition, the actuating sleeves 19 are rigidly connected to one another via the connecting tube 17 coaxial with the axis of rotation C, so that the user can operate the head plate 1 either on one side or on both sides for the purpose of unlocking.

With the design of the head plate 1 according to the disclosure a joint block for each joint axis can be realized on both sides in order to provide a particularly rigid and angularly-displaceable head plate. In addition, the present disclosure provides an unlocking device 24 which can be controlled synchronously from both lateral ends of the head support segment 4, so that a safe and ergonomic adjustment of the headplate position is possible.

LIST OF REFERENCE SIGNS

1 Head plate
2' First rotation joint
3' Second rotation joint
4' Operating table
5' Toggle
6' Standard rail
7' Frame
8' Carrier plate
9' Claw
10' Single block
1 Head plate
2 Coupling arrangement
3 Positioning segment
4 Head support segment
5 First joint arrangement
6 Second joint arrangement
7 Connecting section

8 Lateral slide rail
9 Front mounting rail
10 Padded head support plate
11 Pin joint
12 Tooth arch
13 Release element
13.1 First end section of the release element 13
13.2 Main body of the release element 13
13.3 Second end section of the release element 13
15 Coupling device
16 Receiving element
17 Switching tube
18 Switching plate
19 Actuating sleeve
20 Toothed region of the receiving element 16
22 Blocking device
22.1 First spring receptacle
22.2 Second spring receptacle
23 Actuating device
24 Unlocking device
25 First release mechanism
26 Blocking spring
27 Switching rod
30 Operating table
31 Second unlocking mechanism
A, A' Axes of rotation
a1 First arm of the positioning segment 3
a2 Second arm of the positioning segment 3
α 1 Positive angular range of the positioning segment 3
α 2 Negative angular range of the positioning segment 3
B, B" Axes of rotation
β Angular range of the head support segment 4
C Longitudinal axis of the switching tube 17
F Return spring
G Joint plate
H Spring support
P Pivot point on the release element 13
Q Pivot point on the switching plate 18

The invention claimed is:

1. A displaceable head plate for an operating table, the head plate comprising:

a coupling arrangement;

a positioning segment for positioning the head plate, wherein the positioning segment is pivotably connected to the coupling arrangement via a first joint arrangement that is configured to be locked against pivoting;

a head support segment for supporting the head of a patient, wherein the head support segment is pivotably connected to the positioning segment via a second joint arrangement that is configured to be locked against pivoting; and an unlocking device for unlocking both joint arrangements comprising:

a) an actuating device for actuating the unlocking device by the user, and b) a first unlocking mechanism for unlocking the first joint arrangement, which mechanically couples the actuating device to the first joint arrangement, wherein the first unlocking mechanism comprises a displaceable coupling device, wherein the actuating device is arranged on the head support segment, wherein, starting from the head support segment, the coupling device runs from the actuating device as far as the second joint arrangement and, when unlocked, the coupling device adopts such a position that the head support segment can pivot relative to the positioning segment through a plurality of angular positions, and wherein the first unlocking mechanism comprises a release element which is adjustably mounted between the first and the second joint arrangements and is configured to be connected to the actuating device via the coupling device.

2. The head plate according to claim 1, wherein the coupling device is rotatable about a first pivot point which is remote from the actuating device, and wherein the position of the coupling device in the unlocked state is such that the first pivot point lies on a pivot axis of the second joint arrangement.

3. The head plate according to claim 1, wherein in the unlocked state the coupling device is aligned radially with respect to a pivot axis of the second joint arrangement.

4. The head plate according to claim 1, wherein the coupling device is pivotably articulated on the release element via a first pivot point.

5. The head plate according to claim 1, wherein the coupling device converts a rotational movement of the actuating device into a translational movement of the release element for unlocking the first joint arrangement.

6. The head plate according to claim 1, wherein the release element comprises a first end section assigned to the first joint arrangement and a second end section assigned to the second joint arrangement, wherein the first end section is designed as a latching element and the second end section is connected to the coupling device via a pivot joint.

7. The head plate according to claim 1, wherein the unlocking device comprises a blocking device for blocking the position of the actuating device in the locked state to preclude inadvertent actuation of the actuating device.

8. The head plate according to claim 7, wherein the blocking device is rotatably mounted in the actuating device and is designed such that it is configured to be switched between two discrete latching positions, namely a first latching position for blocking the actuating device and a second latching position for releasing the actuating device.

9. The head plate according to claim 7, wherein the blocking device cooperates with a blocking spring in order to selectively block or release the actuating device.

10. The head plate according to claim 7, wherein the blocking device comprises a switching rod arranged coaxially in a switching tube.

11. The head plate according to claim 1, wherein the actuating device comprises two actuating elements, which are each arranged on opposite sides of the head support segment, and a synchronization element, such that a movement of one actuating element is transferred to the other actuating element.

12. The head plate according to claim 11, wherein the synchronization element is a switching tube.

13. The head plate according to claim 1, wherein the coupling arrangement is configured for releaseably coupling the head plate to the operating table.

14. A displaceable head plate for an operating table, the head plate comprising:

a coupling arrangement;

a positioning segment for positioning the head plate, wherein the positioning segment is pivotably connected to the coupling arrangement via a first joint arrangement that is configured to be locked against pivoting;

a head support segment for supporting the head of a patient, wherein the head support segment is pivotably connected to the positioning segment via a second joint arrangement that is configured to be locked against pivoting; and an unlocking device for unlocking both joint arrangements comprising:

a) an actuating device for actuating the unlocking device by the user, and b) a first unlocking mechanism for unlocking the first joint arrangement, which mechanically couples the actuating device to the first joint arrangement, wherein the first unlocking mechanism comprises a displaceable coupling device, wherein the actuating device is arranged on the head support segment, wherein, starting from the head support segment, the coupling device runs from the actuating device as far as the second joint arrangement and, when unlocked, the coupling device adopts such a position that the head support segment can pivot relative to the positioning segment through a plurality of angular positions, and wherein the unlocking device has a second unlocking mechanism for unlocking the second joint arrangement to allow pivoting of the head support segment relative to the positioning segment, wherein the second unlocking mechanism has a plurality of complementary latching elements, of which one is formed on the positioning segment and the other is formed on the actuating device.

15. The head plate according to claim 14, that wherein in the second unlocking mechanism the locking element formed on the mounting segment comprises a tooth arch, wherein the tooth arch is arranged coaxially to an axis of rotation.

16. The head plate according to claim 14, wherein the coupling device is rotatable about a first pivot point which is remote from the actuating device, and wherein the position of the coupling device in the unlocked state is such that the first pivot point lies on a pivot axis of the second joint arrangement.

17. The head plate according to claim 14, wherein in the unlocked state the coupling device is aligned radially with respect to a pivot axis of the second joint arrangement.

18. A displaceable head plate for an operating table, the head plate comprising:

a coupling arrangement;

a positioning segment for positioning the head plate, wherein the positioning segment is pivotably connected to the coupling arrangement via a first joint arrangement that is configured to be locked against pivoting;

a head support segment for supporting the head of a patient, wherein the head support segment is pivotably connected to the positioning segment via a second joint arrangement that is configured to be locked against pivoting; and an unlocking device for unlocking both joint arrangements comprising:

a) an actuating device for actuating the unlocking device by the user, and b) a first unlocking mechanism for unlocking the first joint arrangement, which mechanically couples the actuating device to the first joint arrangement, wherein the first unlocking mechanism comprises a displaceable coupling device, wherein the actuating device is arranged on the head support segment, wherein, starting from the head support segment, the coupling device runs from the actuating device as far as the second joint arrangement and, when unlocked, the coupling device adopts such a position that the head support segment can pivot relative to the positioning segment through a plurality of angular positions, and wherein the unlocking device is configured to be used to unlock and re-lock both the first joint arrangement and the second joint arrangement one of simultaneously or sequentially.

19. The head plate according to claim 18, wherein the coupling device is rotatable about a first pivot point which is remote from the actuating device, and wherein the position of the coupling device in the unlocked state is such that the first pivot point lies on a pivot axis of the second joint arrangement.

20. The head plate according to claim 18, wherein in the unlocked state the coupling device is aligned radially with respect to a pivot axis of the second joint arrangement.

* * * * *